US011686111B2

(12) United States Patent
Hansort

(10) Patent No.: US 11,686,111 B2
(45) Date of Patent: Jun. 27, 2023

(54) MODULAR PIPE BRACE ASSEMBLY

(71) Applicant: Midwest Concrete & Masonry Supply, Inc., Naperville, IL (US)

(72) Inventor: Marinus Hansort, St. Pete Beach, FL (US)

(73) Assignee: CCS Contractor Equipment & Supply, LLC, Naperville, IL (US)

( * ) Notice: Subject to any disclaimer, the term of this patent is extended or adjusted under 35 U.S.C. 154(b) by 89 days.

(21) Appl. No.: 16/852,713

(22) Filed: Apr. 20, 2020

(65) Prior Publication Data

US 2020/0354980 A1 Nov. 12, 2020

Related U.S. Application Data

(60) Provisional application No. 62/843,617, filed on May 6, 2019.

(51) Int. Cl.

| | |
|---|---|
| ***E04G 17/14*** | (2006.01) |
| ***E04G 21/26*** | (2006.01) |
| ***E04G 11/12*** | (2006.01) |
| ***E04G 13/02*** | (2006.01) |
| ***E04G 25/04*** | (2006.01) |
| ***E04H 12/20*** | (2006.01) |

(52) U.S. Cl.

CPC ..... *E04G 17/14* (2013.01); *E04G 21/26* (2013.01); *E04G 11/12* (2013.01); *E04G 13/02* (2013.01); *E04G 25/04* (2013.01); *E04H 12/20* (2013.01)

(58) Field of Classification Search

CPC ..... E04G 17/14; E04G 21/26; E04G 11/12; E04G 25/04; E04G 11/52; E04G 13/02; E04B 2/8652; E04H 12/20; E04H 12/185

See application file for complete search history.

(56) References Cited

U.S. PATENT DOCUMENTS 2,514,374 A * 7/1950 Cooper ..... B25B 13/52 254/100
2,832,559 A 4/1958 Hillberg
2,960,309 A * 11/1960 Swanson ..... A01G 23/099 254/133 R (Continued)

FOREIGN PATENT DOCUMENTS

CA 2063095 A1 9/1993
DE 4339926 A1 * 6/1995 ..... E04G 11/48

(Continued)

*Primary Examiner* — Brian D Mattei
*Assistant Examiner* — Omar F Hijaz
(74) *Attorney, Agent, or Firm* — Bodman PLC

(57) ABSTRACT

A modular pipe brace assembly is provided for supporting a concrete wall panel, where the modular pipe brace assembly has a plurality of brace sections that each have a pipe with one of at least two standard lengths and a connection plate attached to each end of the pipe. At least two of the plurality of brace sections are attached together in longitudinal alignment by engaging the connection plates to define a pipe assembly with a desired length. An adjustable shoe assembly is attached to each end of the pipe assembly and is configured to engage a ground anchor or a concrete wall panel. The plurality of brace sections may, for example, include a low-load brace section that has a low-load capacity pipe and a high-load brace section that has a high-load capacity pipe.

9 Claims, 10 Drawing Sheets

(56) References Cited

U.S. PATENT DOCUMENTS 3,027,140 A * 3/1962 Holzbach ..... E04G 25/065 254/98
3,700,202 A 10/1972 Donnels
3,798,856 A 3/1974 Gloskowski
3,998,294 A * 12/1976 Moeller ..... E04G 5/04 182/229
4,075,913 A * 2/1978 Tye ..... B25B 13/481 294/210
4,083,156 A 4/1978 Tye
4,737,056 A * 4/1988 Hunt ..... B60P 7/15 224/404
4,872,634 A 10/1989 Gillaspy et al.
4,957,272 A * 9/1990 Lee ..... E04G 17/14 249/196
5,015,117 A * 5/1991 Pawlicki ..... E04B 1/5831 403/300
5,388,808 A * 2/1995 Laitre ..... B66F 3/24 254/134
5,390,970 A * 2/1995 Gray ..... B25J 1/04 294/210
5,765,248 A * 6/1998 Ono ..... E04G 1/34 182/178.1
6,027,102 A * 2/2000 Krupa ..... B66F 13/00 254/134
6,854,222 B2 2/2005 Hansort
8,186,645 B2 5/2012 Shaw et al.
8,616,519 B2 * 12/2013 Bacon ..... E04G 11/486 249/18
8,826,605 B2 9/2014 Recker et al.
2003/0131543 A1 7/2003 Hansort
2006/0207215 A1 9/2006 Bruno
2007/0062134 A1 * 3/2007 Chung ..... E04B 1/18 52/293.3
2007/0175174 A1 8/2007 Bruno
2011/0079698 A1 4/2011 Pezzimenti
2018/0258657 A1 * 9/2018 Chevis ..... E04G 17/002
2019/0368210 A1 12/2019 Recker et al.

FOREIGN PATENT DOCUMENTS

GB 2170525 A 8/1986
WO WO-2009/114902 A1 9/2009

* cited by examiner

MODULAR PIPE BRACE ASSEMBLY

CROSS-REFERENCE TO RELATED APPLICATION

This application claims benefit and priority under 35 U.S.C. § 119(e) of U.S. provisional application Ser. No. 62/843,617, filed May 6, 2019, which is hereby incorporated by reference in its entirety.

TECHNICAL FIELD

The present disclosure generally relates to a brace used to support wall panels and forms, such as during the construction of tilt-up and precast concrete wall panels.

BACKGROUND

It is common during construction to temporarily brace precast concrete structures, such as wall panels or forms or the like, in an upright or vertical orientation with wall braces that extend at an angle from the ground to an elevated portion of the wall. For example, concrete wall panels may be formed on a flat surface and subsequently lifted or tilted up to an upright or vertical orientation, such as with precast or tilt-up wall panels. The upright wall panels may be supported with wall braces that engage an upper location on the wall panels and a stable location on the ground, such as at an earth anchor or a ground anchor cast in or otherwise embedded in a concrete floor structure. Once enough structural components are secured to the braced wall panel for it to be sufficiently supported, the wall braces may be removed.

SUMMARY

The present disclosure provides a modular pipe brace assembly that is used to support a concrete wall panel in an upright or vertical orientation. The modular pipe brace assembly includes at least one standard length brace section that is selected to provide the desired overall bracing length. To reduce the high inventory levels of traditional wall braces that are necessary for diverse construction projects, the modular pipe brace assembly disclosed herein provides brace sections that each have a pipe with one of at least two standard lengths, such as 10 foot brace sections and 40 foot brace sections. These standard length brace sections may be assembled to provide the desired overall bracing length, such as 52 feet, 62 feet, 82 feet or other length combinations, while also providing the needed increased load capacity for longer brace extensions. For example, the longer standard length brace sections may include a higher load capacity than shorter standard length brace sections, such as due to the longer standard length brace sections having a larger diameter. Accordingly, the modular pipe brace assembly may provide brace sections that each have a pipe with one of at least two standard load capacities. To facilitate brace section engagement, the longer standard length or higher-load capacity brace sections may be configured to attach to multiple different standard brace sections, such as to a shorter brace section or another longer brace section, in addition to being capable of attaching to a shoe assembly. Once a project is complete, the pipe brace assembly may be disassembled and later reassembled, such as in a different configuration and overall length to accommodate a different project or otherwise support a different wall panel.

According to one aspect of the present disclosure, a modular pipe brace assembly is provided for supporting a concrete wall panel, where the modular pipe brace assembly has a plurality of brace sections that each have a pipe with one of at least two standard lengths and a connection plate attached to each end of the pipe. At least two of the plurality of brace sections are attached together in longitudinal alignment by engaging the connection plates to define a pipe assembly with a desired length. An adjustable shoe assembly is attached to each end of the pipe assembly and is configured to engage a ground anchor or a concrete wall panel. The plurality of brace sections may, for example, include a low-load brace section that has a low-load capacity pipe and a high-load brace section that has a high-load capacity pipe.

According to another aspect of the present disclosure, a modular pipe brace assembly for supporting a concrete wall panel includes a plurality of low-load brace sections that each have a low-load pipe and a high-load brace section that has a high-load pipe. At least one of the low-load brace sections is attached to an end of the high-load brace section with the high-load pipe disposed in longitudinal alignment with the at least one low-load pipe to define a pipe assembly with a desired bracing length. The plurality of low-load brace sections may have a standard length, and the high-load brace section may have a longer length than the standard length of the plurality of low-load brace sections. Moreover, the high-load brace section may have a multi-connection plate attached to each end of the high-load pipe, where the multi-connection plate is configured to engage a shoe assembly, the plurality of low-load brace sections, and another high-load brace section.

According to yet another aspect of the present disclosure, a modular pipe brace assembly for supporting a concrete wall panel includes a plurality of brace sections that each comprise a long pipe brace or a short pipe brace. The short pipe brace has a connection plate attached to each end and the long pipe brace has a multi-connection plate attached to each end that is configured to attach to the connection plate of the short pipe brace or another long pipe brace. At least two of the brace sections are attached together in longitudinal alignment by engaging the adjoining connection plates to provide a rigid pipe assembly. Also, a shoe assembly is attached to each end of the rigid pipe assembly, where the shoe assembly has an adjustable length.

According to a further aspect of the present disclosure, a modular pipe brace assembly for supporting a concrete wall panel includes a plurality of brace sections that each comprise (i) a low-load brace section having a low-load pipe with a connection plate attached to each end of the low-load pipe or (ii) a high-load brace section having a high-load pipe and a multi-connection plate attached to each end of the high-load pipe. The multi-connection plate is configured to attach to the connection plate of a low-load brace section or another high-load brace section. At least two of the plurality of brace sections are attached together in longitudinal alignment by engaging the adjoining connection plates to provide a rigid pipe assembly with a desired bracing length.

These and other objects, advantages, purposes, and features of the present disclosure will become apparent upon review of the following specification in conjunction with the drawings.

DETAILED DESCRIPTION

Figure 1:
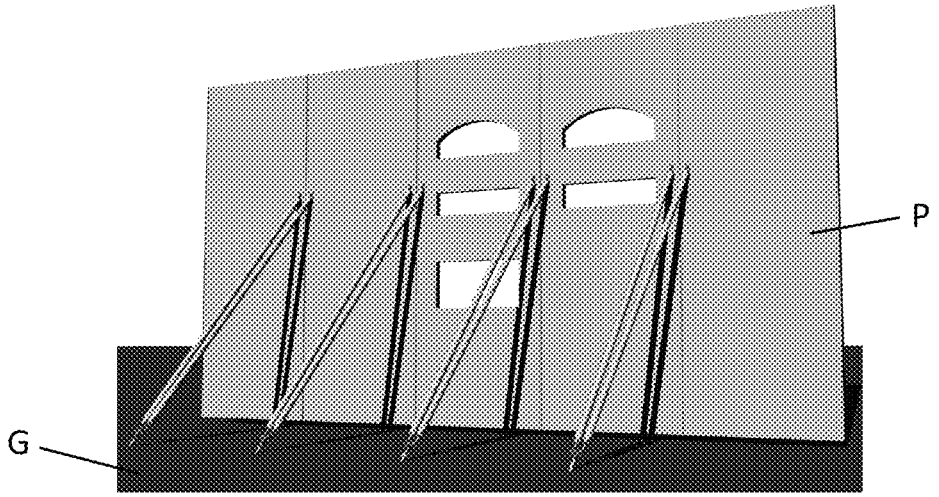
FIG. 1 is a perspective view of several wall panels supported by pipe braces connected to ground anchors.

Referring now to the drawings and the illustrative embodiments depicted therein, wall braces, such as shown, for example, in FIG. 1, generally extend at an angle from the floor or ground G to an elevated portion of a wall panel P to temporarily support the wall panel in a desired upright or vertical position, such as during construction of an associated building or structure or the like. The upper ends of the wall braces may be temporarily attached to the wall panel, such as with fasteners or the like, to secure the upper ends of the wall braces to the panel before or after lifting and positioning the wall panel and before or after securing or attaching the lower ends of the wall braces to the ground. The lower ends of the wall braces may be temporarily attached to a ground anchor, such as at an earth anchor that has a helical or threaded shape to engage the ground. Each wall brace may have its own dedicated ground connection or multiple wall braces may be connected at a single ground anchor, such as shown in FIG. 1.

In addition to the potential ground anchor location or locations, the size, shape, weight, and type of wall panel may dictate the desired bracing location or locations on the wall panel and may also contribute to the corresponding desired load capacity of the wall brace. For example, the wall panels may be concrete precast panels with internal reinforcements and/or insulation, such as a sandwich panel arrangement, and may also include inserted anchors for attaching panel lifting devices and engaging the wall braces. Also, the wall panels may be designed for various uses in construction, such as cladding walls, load-bearing walls, shear walls, or formwork for cast-in place concrete. In view of the variety of wall panels, the desired length and loading capacity for wall braces used with different wall panel installations and construction projects may vary significantly.

Figure 2:
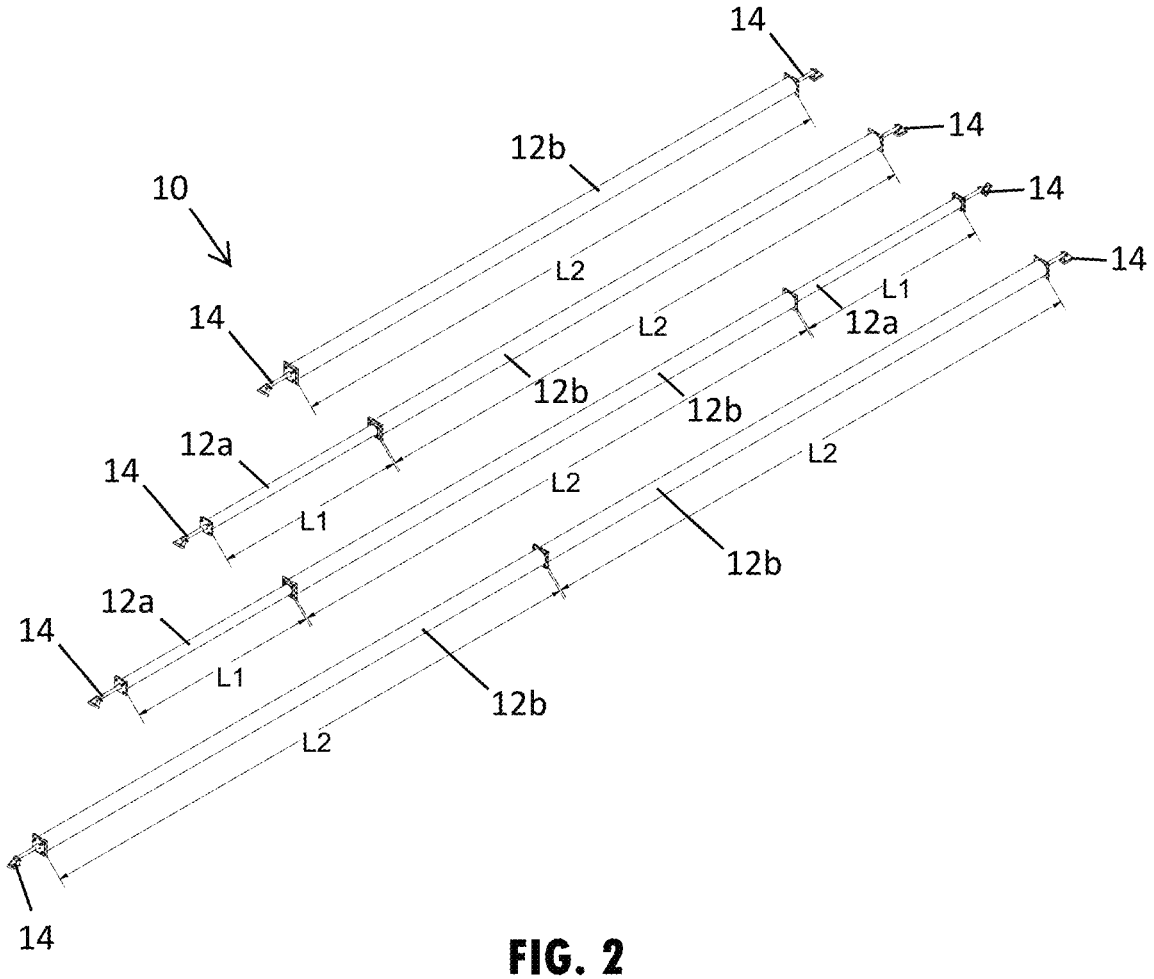
FIG. 2 is a perspective view of several configurations of modular pipe brace assemblies attached together in different desired lengths.

A modular pipe brace assembly 10, such as shown in FIG. 2, provides various length and load capacity solutions for temporarily supporting several differently sized, shaped, weighted, and types of concrete wall panels in an upright or vertical orientation. To provide the various lengths, generally at least two brace sections are attached together in longitudinal alignment by engaging the adjoining ends of the brace sections to define a pipe assembly with a desired length. The brace sections are attached in a removable manner, such as with removable bolts, so that the brace sections may be reassembled in a different configuration, such as with another one of the brace sections, to provide a different pipe assembly for a different use. Also, for shorter bracing lengths, a single brace section may be utilized. To reduce the inventory levels associated with traditional wall braces, the modular pipe brace assembly 10 may include at least one standard length brace section that has a commonly used bracing length. As shown in FIG. 2, the modular pipe brace assembly 10 includes two different brace sections 12*a*, 12*b* that each have a standard length L1 and L2. As illustrated in FIG. 2, the first standard length L1 is a 10 foot brace section 12*a* and the second standard length L2 is a 40 foot brace section 12*b*. In additional examples, the standard lengths may vary, such as 20, 30, or 60 foot brace sections.

As shown in FIG. 2, assembling the exemplary standard length brace sections 12*a*, 12*b* with shoe assemblies 14 at each end provides a 50 foot pipe assembly (with a total length of 52 feet when considering the shoe assemblies 14), a 60 foot pipe assembly (with a total length of 62 feet when considering the shoe assemblies 14), and a 80 foot pipe assembly (with a total length of 82 feet when considering the shoe assemblies 14). It is also contemplated that any of the pipe assemblies shown in FIG. 2 may be extended by adding one or two of the shorter brace sections to the ends, so as to provide 70 or 90 foot pipe assemblies. The longer, 40 foot brace sections 12*b* may also be used individually on a pipe brace, as also shown in FIG. 2, and the shorter 10 foot pipe sections 12*a* may also be used individually or attached together for shorter bracing lengths, such as for pipe assemblies with desired 10, 20, or 30 foot spans. It is contemplated that different standard lengths may be provided from those illustrated, and it is understood that more than one or two standard lengths of brace sections may be used with the pipe brace assembly.

The standard length brace sections 12*a*, 12*b* may be assembled to provide the desired overall bracing length, while also providing the needed increased load capacity for longer brace extensions. For example, the longer standard length brace sections 12*b* may include a higher load capacity than shorter standard length brace sections 12*a*, as there are often higher load requirements when the elevation of the bracing locations increases. Also, as the overall length of a wall brace increases, the central portion of the wall brace often has the highest loading requirement or bending strength requirement along the length of the wall brace. Thus, the modular pipe brace assembly 10 may provide brace sections that each have a pipe with one of at least two load capacities, where the high-load brace section 12*b* may have a longer length than the standard length of the low-load brace section 12*a* and where the high-load brace section 12*b* is disposed at the central portion of the bracing length.

The pipe assembly or single pipe sections may engage with the wall panel and the floor or ground anchor by using a shoe assembly that is attached to each end of the pipe assembly. As shown in FIG. 2, the shoe assemblies 14 may add to the overall length of the modular pipe brace assembly 10, such as to add a foot to each end of the pipe assembly and provide the exemplary illustrated overall lengths of 42 feet, 52 feet, 62 feet, and 82 feet (not illustrated to scale). The shoe assemblies 14 may also have an adjustable length from approximately negligible or 1 inch of extension beyond the end of the pipe assembly to approximately 32 inches or 30 to 35 inches of extension beyond the end of the pipe assembly. It is understood that additional examples of the shoe assemblies may be configured to extend further that the ranges described herein.

Figure 3:
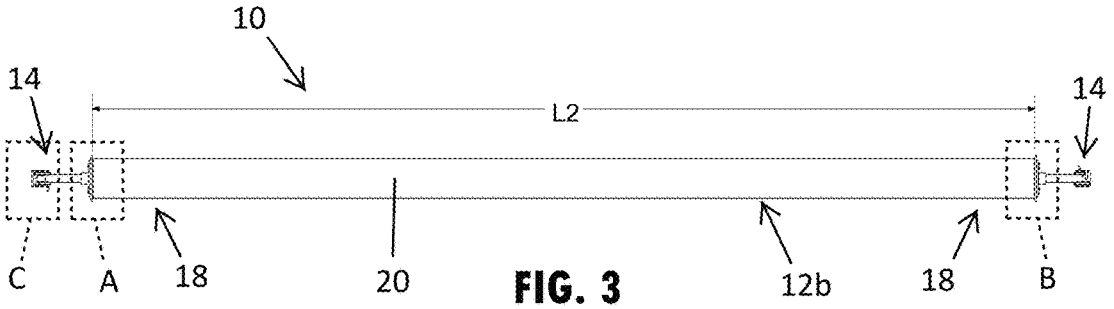
FIG. 3 is an elevational view of the pipe brace assembly shown in FIG. 2 that is assembled with a single brace section.

As shown in FIG. 3, the pipe brace assembly 10 provides a single brace section 12*b* that is approximately 40 feet long and has shoe assemblies 14 attached to opposing ends of the brace section 12*b*. To facilitate engagement of the brace section to the shoe assemblies 14, the brace section 12*b* has a connection plate 16 that is attached to the opposing ends 18 of a pipe 20 that extends along the substantial entire length of the brace section 12*b*. The connection plate 16 is attached to the end of the pipe 20 in generally perpendicular planar alignment relative to the length of the pipe 20. The shoe assembly 14 has a mounting plate 22 that is removably attached to and against the connection plate 16 of the brace section 12*b*, such as with the bolts 24 shown in FIGS. 3A-3B that extend through the mounting plate 22 and the connection plate 16 to dispose the ends of the bolts 24 within a hollow interior of the pipe 20 of the brace section 12*b*. The bolts 24 hold the shoe assembly 14 to the brace section 12*b* by threadably engaging threads formed in holes 25 that extend through the connection plate 16. It is also contemplated that in other example that welded nuts or other conceivable thread connectors may be provided on the connection plate to engage bolts.

Figure 3A:
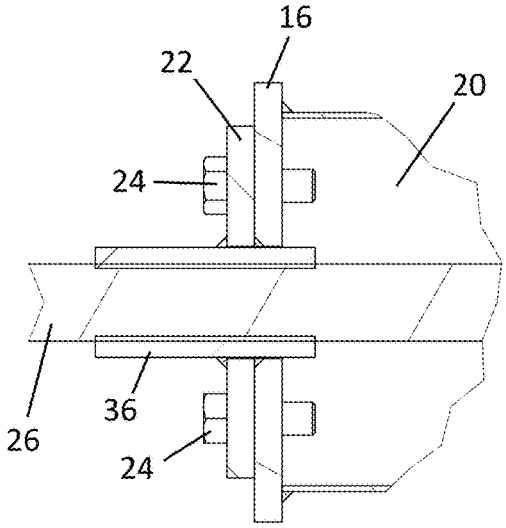
FIG. 3A is an enlarged view taken at section A of FIG. 3, showing a connection plate of the brace section attached to a shoe assembly.
Figure 3B:
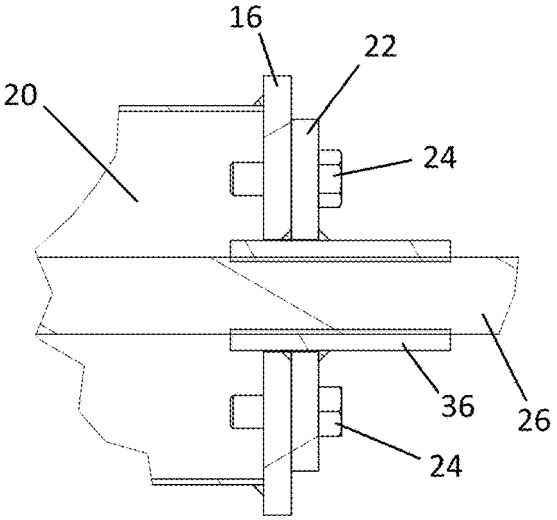
FIG. 3B is an enlarged view taken at section B of FIG. 3, showing another connection plate of the brace section attached to another shoe assembly.
Figure 3C:
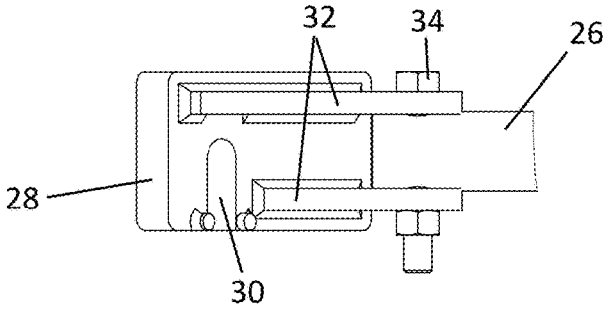
FIG. 3C is an enlarged view taken at section C of FIG. 3, showing a shoe portion of the shoe assembly.

The shoe assembly 14 may also have a threaded rod 26 and a shoe 28 pivotally attached to an end of the rod 26, such as shown in FIG. 3C. The shoe 28 shown in FIG. 3C has a slot 30 in the base of the shoe 28 for engaging a post, fastener, or other protrusion extending from or part of a ground anchor or slab anchor. Also, the shoe 28 may have arms 32 that extend from the base at a spacing from each other to receive the end of the threaded rod 26 between the arms 32. To provide pivotal motion of the shoe 28 relative to the threaded rod 26, a fastener, such as a bolt 34 as shown in FIG. 3C, may connect between the arms 32 and extend through a transverse hole 33 (FIG. 8) formed in the end of the rod 26 that is disposed transverse to the length of the rod 26.

As also shown in FIGS. 3A and 3B, the threaded rod 26 operably engages the mounting plate 22 by extending though a threaded central aperture disposing within a barrel 36 that is fixed to the mounting plate 22 of the shoe assembly 14 at a central and longitudinally disposed location relative to the pipe 20. The threaded rod 26 is permitted to rotate and cause longitudinal translation or displacement of the shoe 28 relative to the brace section 12*b* by rotation of the threaded rod 26 relative to the mounting plate 22. As such, the effective length of the shoe assemblies 14 may be adjusted, such as to adjust the length from approximately negligible or 1 inch of extension beyond the end of the pipe assembly to approximately 32 inches or 30 to 35 inches of extension beyond the end of the pipe assembly. The range of adjustability of the shoe assembly is based, at least in part, on the strength and diameter of the rod 26 and the threaded engagement with the mounting plate 22, such that it is contemplated that the range of adjustability may be greater or less than 35 inches in other examples of the shoe assembly.

Figure 4:
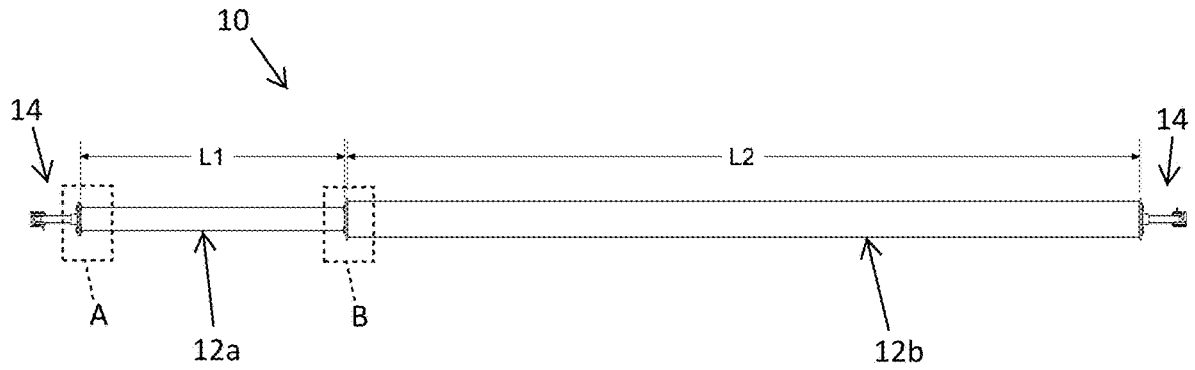
FIG. 4 is an elevational view of another pipe brace assembly shown in FIG. 2.
Figure 4A:
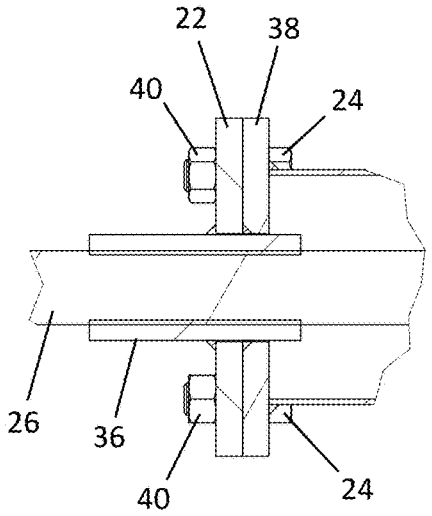
FIG. 4A is an enlarged view taken at section A of FIG. 4, showing a connection plate of a brace section attached to a shoe assembly.
Figure 4B:
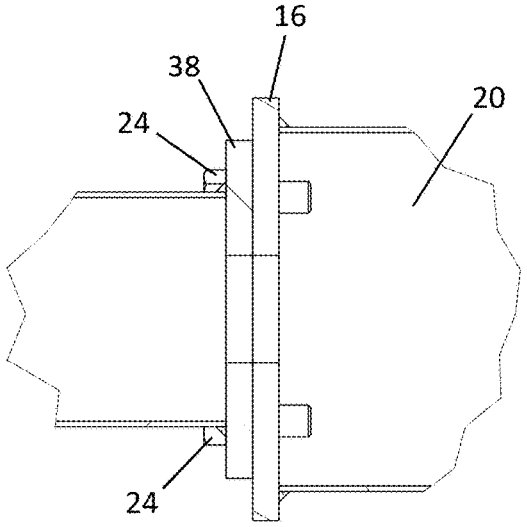
FIG. 4B is an enlarged view taken at section B of FIG. 4, showing the attached connection plates of different sized brace sections.

As shown in FIGS. 4-4B, the pipe brace assembly 10 provides two different brace sections 12*a*, 12*b* attached to each other in longitudinal alignment by engaging the connection plate 16 of the 40 foot brace section 12*b* with the connection plate 38 of the shorter, 10 foot brace section 12*a*. When the central axes of the brace sections are aligned and the ends are abutting, the brace sections 12*a*, 12*b*, such as shown in FIG. 4B, are temporarily attached together with bolts 24 that extend through an outer flange of the smaller connection plate 38 and into the threaded holes 25 (FIG. 7A) of the larger connection plate 16. Although temporary, the bolted attachment of brace sections provides a rigid and stable connection for the pipe assembly. At the end of the pipe assembly provided by the end of the shorter, 10 foot brace section 12*a*, a shoe assembly 14 may be attached to the outer flange of the smaller connection plate 38, such as shown in FIG. 4A with bolts 24 and nuts 40 that clamp the mounting plate 22 of the shoe assembly 14 to the connection plate 38 of the brace section 12*a*. It is contemplated that the smaller connection plate of a shorter brace section in other examples may include threaded holes similar to those provided in the larger connection plate 16 shown in FIG. 4B.

Figure 5:
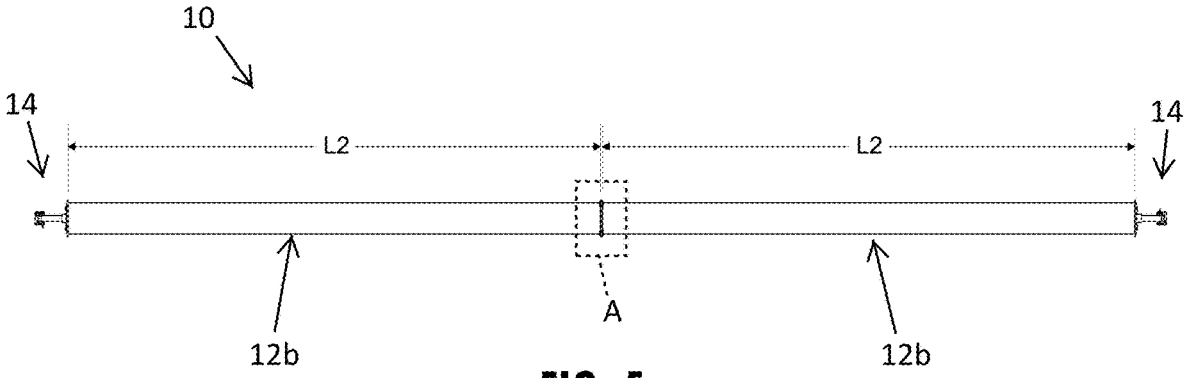
FIG. 5 is an elevational view of another pipe brace assembly shown in FIG. 2.

Furthermore, as shown in FIG. 5, the pipe brace assembly 10 provides the use of two longer brace sections 12*b* disposed in longitudinal alignment and attached to each other, so as to provide an 80 foot pipe assembly. The brace sections 12*b* are temporarily or removably attached together when the central axes of the brace sections 12*b* are aligned by engaging the connection plates 16 together by using a second set of holes 42 in the connection plate 16 (FIG. 7A) that extend through the outer flange of the connection plates 16 at an outer radial spacing from the threaded holes 25. Thus, to facilitate the assembly of various pipe brace assemblies using different types of brace sections, one of the brace sections, such as the longer standard length or higher-load capacity brace sections 12*b*, may be configured to attach to multiple different brace sections, such as to a shorter brace section 12*a* (FIG. 4), a longer brace section 12*b* (FIG. 5), or a shoe assembly 14 (FIG. 3), among other conceivable brace sections.

Figure 6:
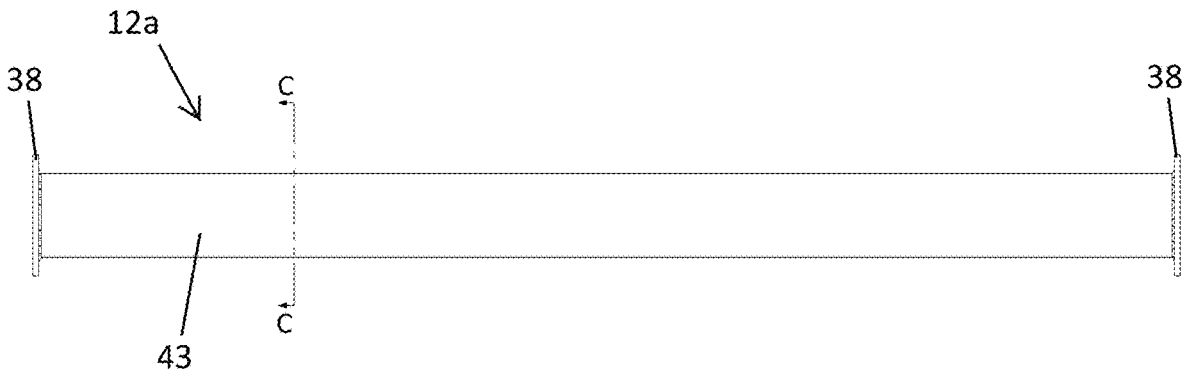
FIG. 6 is an elevational view of the shorter pipe brace section shown in FIG. 4.
Figure 6A:
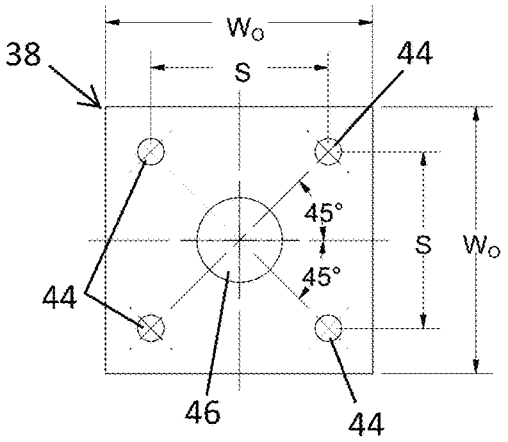
FIG. 6A is an end view of the pipe brace section shown in FIG. 6, showing a face of the connection plate.
Figure 6B:
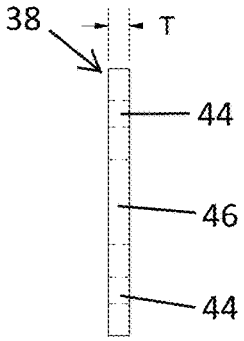
FIG. 6B is a side view of the connection plate shown in FIG. 6A.
Figure 6C:
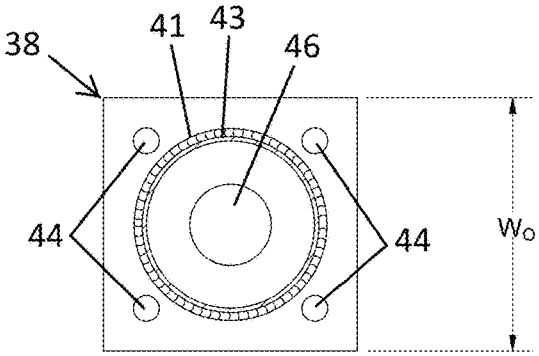
FIG. 6C is a cross-sectional end view of the pipe brace section shown in FIG. 6, taken at section line C-C.

As shown in greater detail in FIGS. 6-6C, the pipe brace section 12*a* has a pipe 43 with a circular transverse cross-sectional shape. The circular cross-sectional shape of the pipe 20 has a diameter of 8 inches, which is larger than the diameter of the pipe of the shorter pipe brace section 12*a*. The ends of the pipe 43 are cut perpendicular to the length of the pipe 43 and attached via welding to the square-shaped connection plate 38, where the weld 41 is provided around the circumference of the pipe 43. The holes 44 in the connection plate 38 that receive fasteners for securing the pipe brace section 12*a* to other pipe brace sections or the foot assembly may be formed in the corners of the outer flange of the connection plate 38, such as shown in FIG. 6C outside the circumference of the pipe 43. The connection plate 38 may also include a central hole 46 that can receive the threaded rod 26 of the shoe assembly 14, such as when the threaded rod 26 is retracted to provide the shoe assembly 14 with a shorter or intermediate length, such as shown in FIG. 4A. Accordingly, the multiple holes provided in the connection plate 38 allows shorter pipe brace section 12*a* to connect to a longer brace section 12*b*, another shorter brace section 12*a*, or a shoe assembly 14, among other conceivable brace sections.

As shown in FIGS. 6A-6C, the dimensions of the exemplary connection plate 38 include an outer width $W_O$ of 8 inches between each of the opposing outer sides to provide a square shape. Also, the thickness T of the connection plate 38 is 0.625 inches. The holes 44 in the connection plate 38 are disposed at an equal distance from the central hole 46 at a 45 degree angle from the liner extent of the outer sides of the connection plate. As a result, the spacing S between the holes 44 is 5.3 inches. It is contemplated that other dimensions and configurations may be provided in additional examples of the connection plate.

Figure 5A:
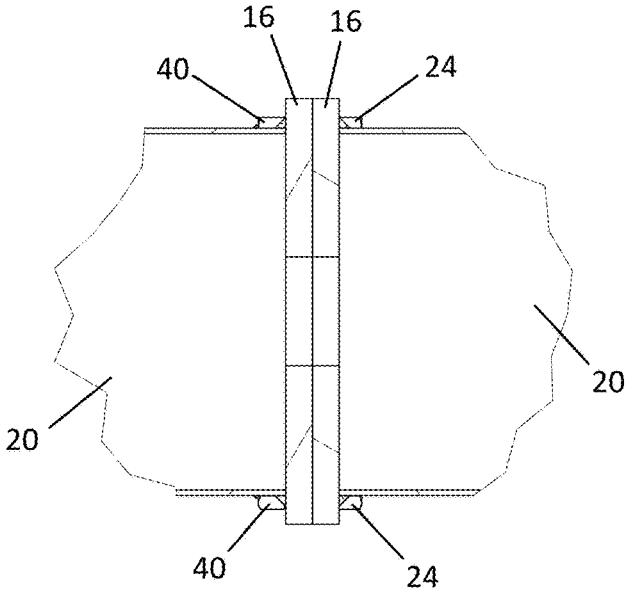
FIG. 5A is an enlarged view taken at section A of FIG. 5, showing the attached connection plates of the brace sections.
Figure 7:
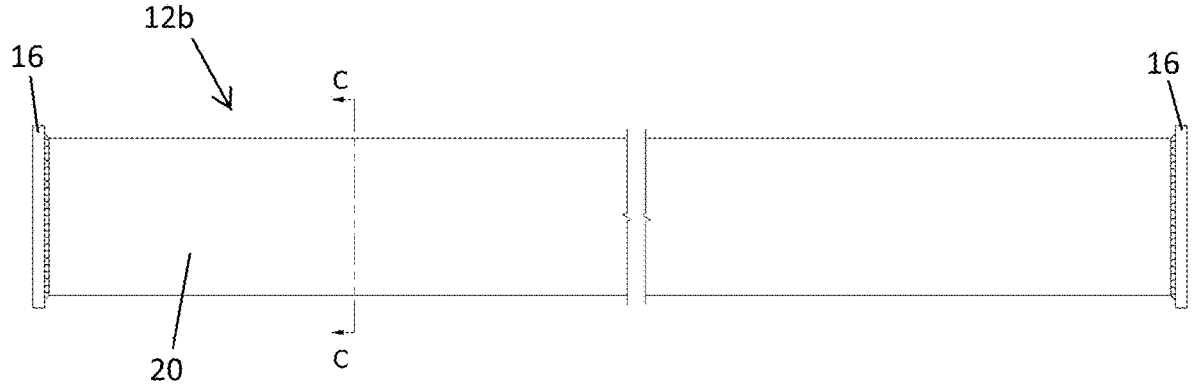
FIG. 7 is an elevational view of the longer pipe brace section shown in FIG. 4.
Figure 7A:
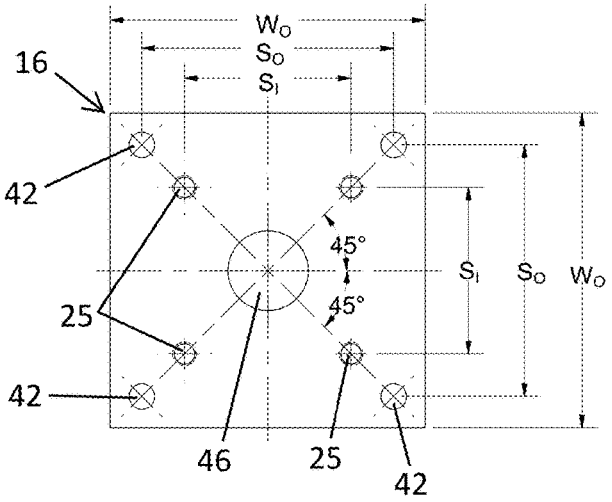
FIG. 7A is an end view of the pipe brace section shown in FIG. 7, showing a face of the connection plate.
Figure 7B:
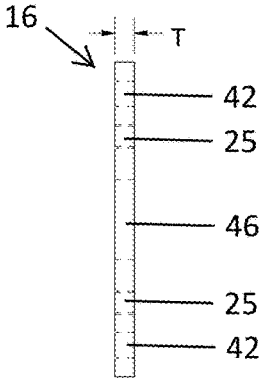
FIG. 7B is a side view of the connection plate shown in FIG. 7A.
Figure 7C:
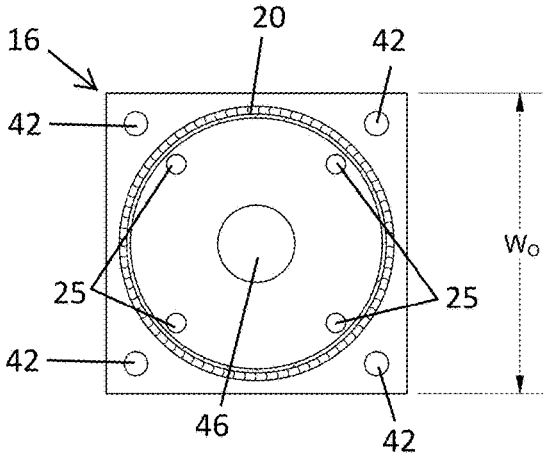
FIG. 7C is a cross-sectional view of the pipe brace section shown in FIG. 7, taken at section line C-C.

The longer pipe brace section 12*b*, as shown in greater detail in FIGS. 7-7C, also includes a pipe 20 that has a circular transverse cross-sectional shape and a larger diameter than the pipe 43 of the shorter pipe brace section 12*a* so as to provide a higher load capacity. Such a higher load capacity may also be provided with an increase in the gauge of the pipe wall or with the type of material used, such as a higher strength steel (e.g., advanced high strength steel) or aluminum alloy. The ends of the pipe 20 are cut perpendicular to the length of the pipe 20 and attached via welding to the square-shaped connection plate 16, where the weld is provided around the circumference of the pipe 20. The connection plate 16 has two sets of peripheral holes 25, 42 that receive fasteners for securing the pipe brace section 12*b* to other pipe brace sections or the foot assembly. The outer holes 42 formed in the corners of the outer flange of the connection plate 16, such as shown in FIG. 6C, are provided radially outside the circumference of the pipe 20 to engage another one of the longer pipe brace sections 12*b* (FIG. 5A). The connection plate 16 also includes inner holes 25 inside the circumference of the pipe 20 that may threadably engage bolts 24 that attach the smaller pipe brace section 12*a* (FIG. 4B) or the shoe assembly 14 (FIGS. 3A and 3B). Further, similar to the smaller connection plate 48, a central hole 46 may be provided in the connection plate, as shown in FIGS. 7A-7C that may receive the threaded rod of the shoe assembly, such as when the threaded rod is retracted to provide the shoe assembly with a shorter or intermediate length (FIG. 3A). Accordingly, the multiple types of holes provided in the connection plate 16 allows the longer pipe brace section 12*b* to connect to a shorter brace section 12*a*, another longer brace section 12*b*, or a shoe assembly 14, among other conceivable brace sections.

As shown in FIGS. 7A-7C, the dimensions of the exemplary connection plate 16 include an outer width $W_O$ of 10 inches between each of the opposing outer sides to provide a square shape. Also, the thickness T of the connection plate 38 is 0.625 inches. The holes 25, 42 in the connection plate 38 are each disposed at a distance from the central hole 46 at a 45 degree angle from the liner extent of the outer sides of the connection plate. As a result, the spacing $S_O$ between the outer holes 42 is 8 inches and the space Si between the inner holes 25 is 5.3 inches. Again, it is contemplated that other dimensions and configurations may be provided in additional examples of the connection plate.

Figure 8:
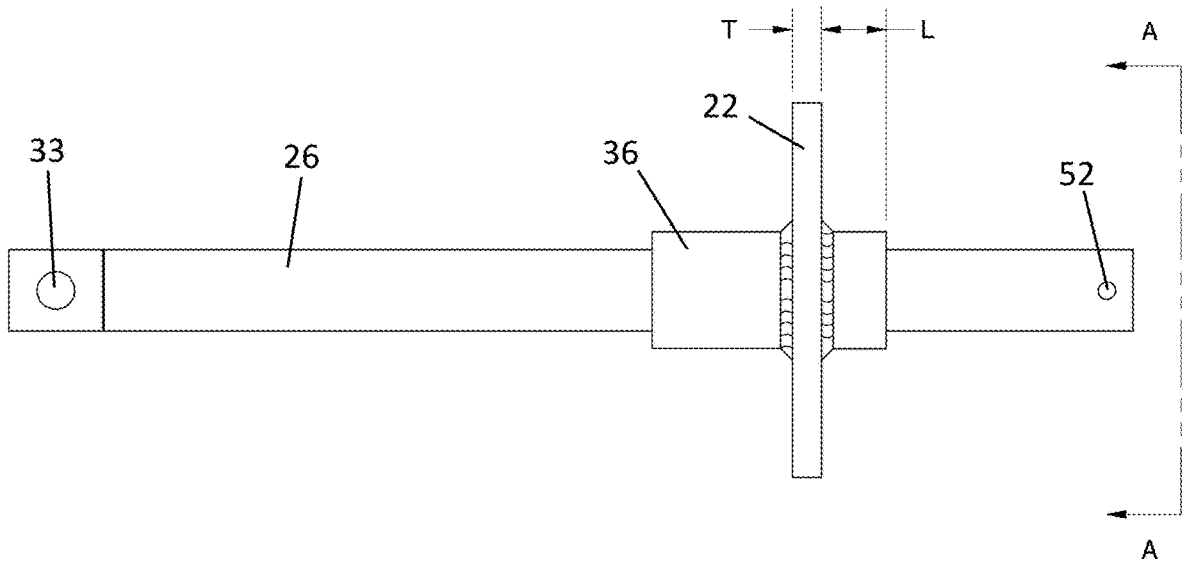
FIG. 8 is an elevational view of a portion of a shoe assembly, showing a threaded rod and a mounting plate.
Figure 8A:
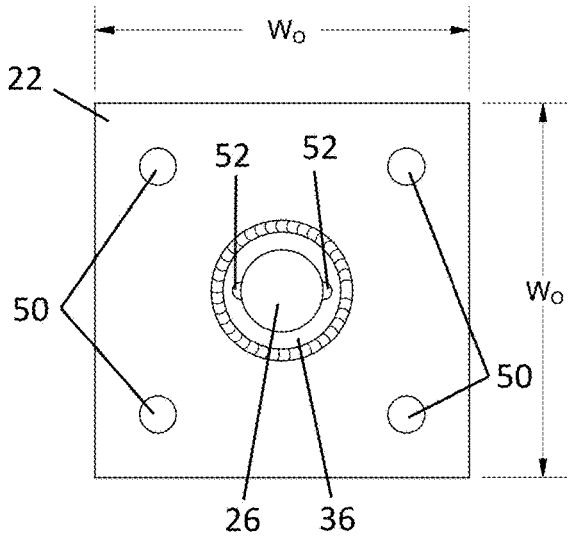
FIG. 8A is an end view of the portion of the shoe assembly shown in FIG. 8.

As shown again in FIGS. 8 and 8A, the shoe assembly 14 is provided with the threaded rod 26 that is operably engaged with the mounting plate 22 by extending though a threaded barrel 36 that is fixed to the mounting plate 22. The mounting plate 22 has a square shape in this illustrated example (FIG. 8A) and has holes 50 that are configured to align with the holes 44 (FIG. 6A) in the connection plate 38 of the shorter brace section 12*a* and the inner holes 25 (FIG. 7A) on the connection plate 16 of the longer brace section 12*b*. As also shown in FIG. 8, the end of the threaded rod 26 that engages the shoe 28 (FIG. 3C) has a transverse hole 33 for receiving the fastener that engages the shoe 28. The other end of the threaded rod 26 includes a lateral protrusions 52 that act as a stop to limit the extendable length of the shoe assembly 14, as extending beyond the protrusions 52 would disengage the threaded rod 26 from the mounting plate 22. Thus, to adjust the length of the shoe assemblies 14, the threaded rod 26 is permitted to rotate relative to the mounting plate 22 to longitudinally displace or translate the shoe relative to the corresponding pipe assembly.

As further shown in FIGS. 8 and 8A, the dimensions of the mounting plate 22 of the exemplary shoe assembly 14 include an outer width $W_O$ of 8 inches between each of the opposing outer sides to provide a square shape. Also, the thickness T of the mounting plate 22 is 0.625 inches. The length L of the inner portion of the threaded barrel 36 that extends into the engaged pipe extension is 1.375 inches. Again, it is contemplated that other dimensions and configurations may be provided in additional examples of the shoe assembly.

Figure 9:
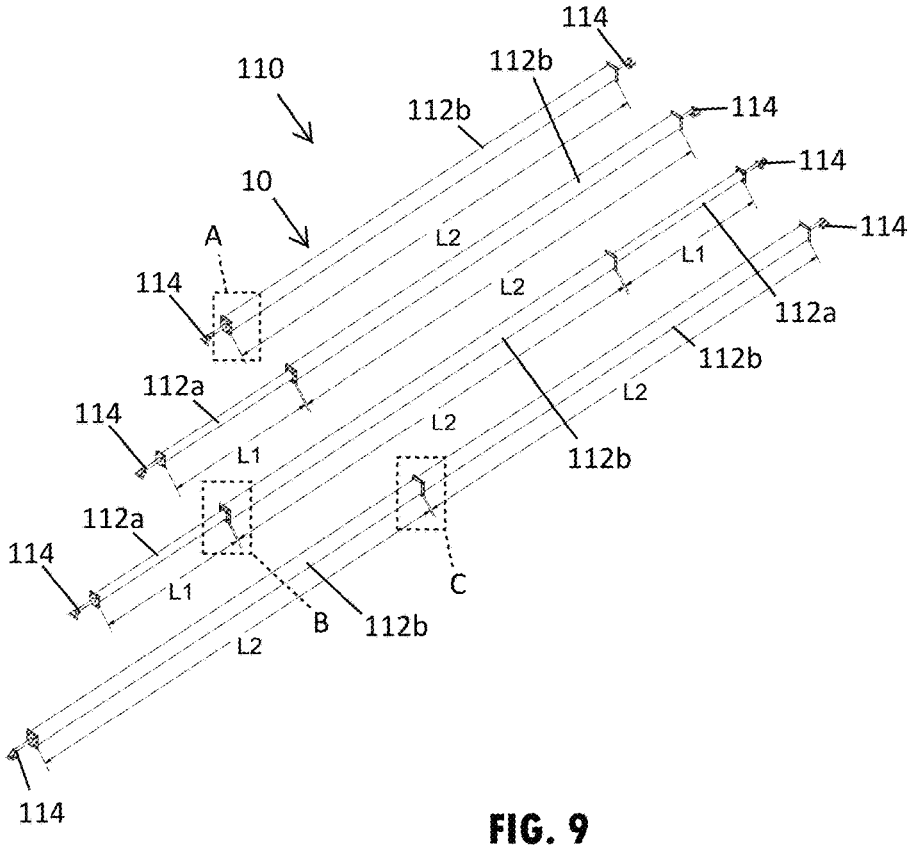
FIG. 9 is a perspective view of several configurations of additional modular pipe brace assemblies in accordance with the present disclosure.
Figure 10:
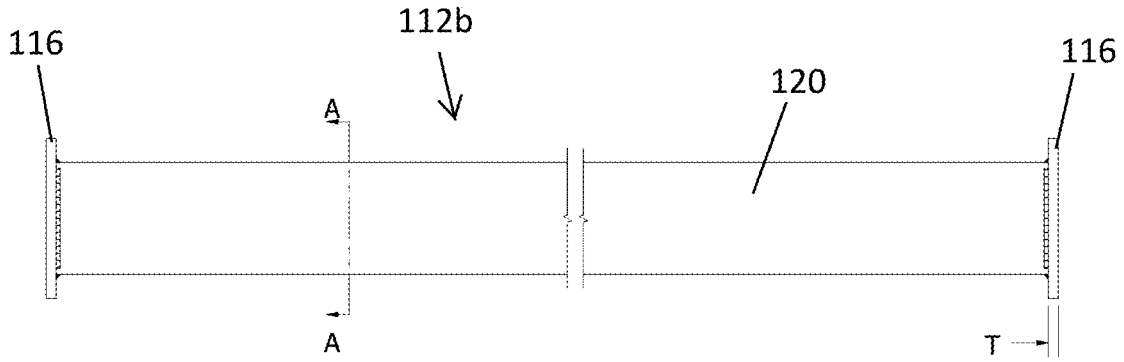
FIG. 10 is an elevational view of the longer pipe brace section shown in FIG. 9, shown without an intermediate portion thereof.
Figure 10A:
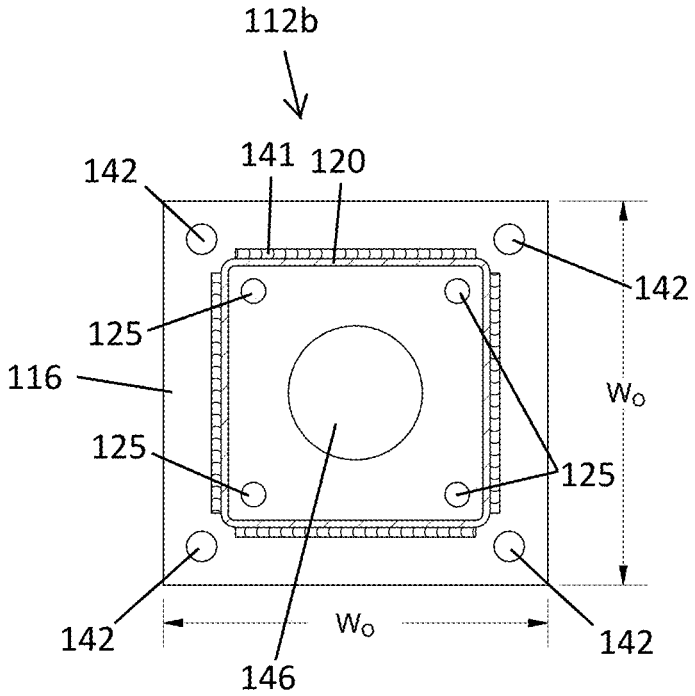
FIG. 10A is a cross-sectional view of the pipe brace section shown in FIG. 10, taken at section line A-A.

Referring now to FIGS. 9-10A, another example of the pipe brace assembly 110 also provides various length and load capacity solutions for temporarily supporting several differently sized, shaped, weighted, and types of concrete wall panels in an upright or vertical orientation. The pipe brace assembly 110 is substantially similar to the example shown in FIG. 2, as the modular pipe brace assembly 110 includes two different brace sections 112*a*, 112*b* that each have a standard length L1 and L2. As illustrated in FIG. 10, the first standard length L1 is a 10 foot brace section 112*a* and the second standard length L2 is a 40 foot brace section 112*b*. In additional examples, the standard lengths may vary, such as 20, 30, or 60 foot brace sections.

As shown in FIG. 9, assembling the exemplary standard length brace sections 112*a*, 112*b* with shoe assemblies 114 at each end provides a 50 foot pipe assembly (with a total length of 52 feet when considering the shoe assemblies 114), a 60 foot pipe assembly (with a total length of 62 feet when considering the shoe assemblies 114), and a 80 foot pipe assembly (with a total length of 82 feet when considering the shoe assemblies 114). However, different from the exemplary brace section 12*b* shown in FIG. 7, the longer pipe brace section 112*b*, as shown in greater detail in FIGS. 10 and 10A, includes a pipe 120 that has a square transverse cross-sectional shape. The square cross-sectional shape of the pipe 120 has a diameter of 7 inches parallel to the sides of the pipe 120, which is larger than the diameter of the pipe of the shorter pipe brace section 112*a*.

Figure 9A:
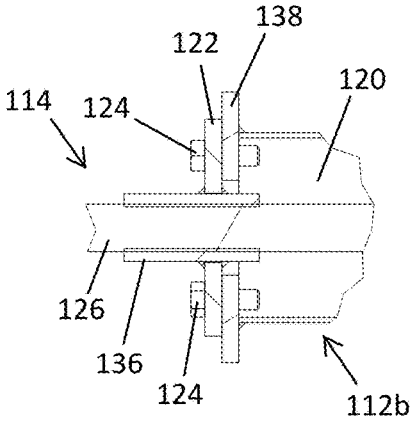
FIG. 9A is an enlarged view taken at section A of FIG. 9, showing a connection plate of a brace section attached to a shoe assembly.
Figure 9B:
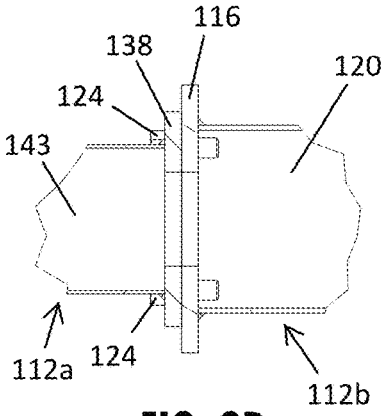
FIG. 9B is an enlarged view taken at section B of FIG. 9, showing the attached connection plates of different sized brace sections.
Figure 9C:
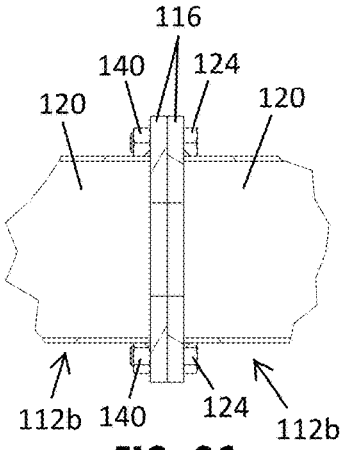
FIG. 9C is an enlarged view taken at section C of FIG. 9, showing the attached connection plates of the brace sections.

As shown in FIGS. 10 and 10A, the ends of the square pipe 120 are cut perpendicular to the length of the square pipe 120 and attached via welding to the square-shaped connection plate 116, where the weld 141 is provided substantially around the circumference of the pipe 120. The connection plate 116 has two sets of outer peripheral holes 142, 125 that receive fasteners, such as bolts 124 and nuts 140, for securing the pipe brace section 112*b* to other pipe brace sections (FIGS. 9B and 9C) or the foot assembly 114 (FIG. 9A). Further, a central hole 146 is shown in the connection plate 116 that may receive the threaded rod of the shoe assembly 114, such as when the threaded rod is retracted to provide the shoe assembly with a shorter or intermediate length (FIG. 9A).

As further shown in FIGS. 10 and 10A, the dimensions of the exemplary connection plate 116 include an outer width $W_O$ of 10 inches between each of the opposing outer sides to provide a square shape. Also, the thickness T of the connection plate 116 is 1.25 inches. The holes 125, 142 in the connection plate 116 are each disposed at a distance from the central hole 146 at a 45 degree angle from the liner extent of the outer sides of the connection plate, such as to be disposed inside and outside the corners of the pipe 120. Again, it is contemplated that other dimensions and configurations may be provided in additional examples of the connection plate.

Figure 11:
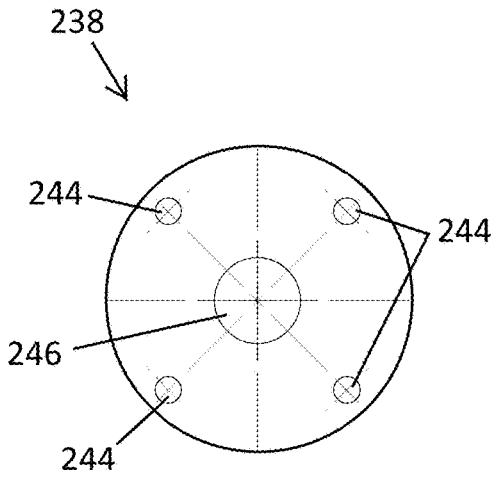
FIG. 11 is an end view of an additional connection plate of a pipe brace section.
Figure 12:
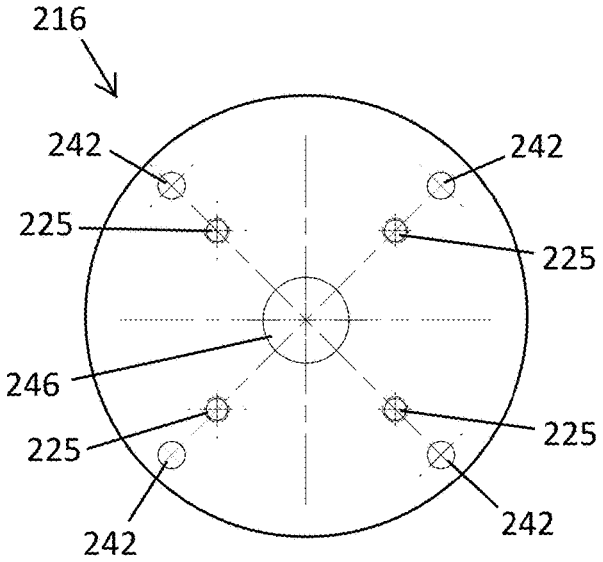
FIG. 12 is an end view of an additional connection plate of a pipe brace section.

Furthermore, one or more of the mounting and connection plates used with a modular pipe brace assembly may also have a different shape from those shown in FIGS. 2-10A, such as the additional exemplary shapes shown in FIGS. 11-14. Specifically, FIGS. 11 and 12 show a circular shaped, smaller connection plate 238 for a shorter brace section and a circular shaped, larger connection plate 216 for a longer brace section. Similar to the examples shown and described above, the connection plates 238, 216 have multiple holes for temporarily attaching to different brace sections or foot assemblies. The smaller connection plate 238 has four perimeter holes 244 that are disposed at the outer flange of the corresponding brace section, such that fasteners that engage the holes 244 are disposed outside the hollow interior of the pipe of the corresponding brace section. The larger connection plate 216 has two sets of outer peripheral holes 242, 225 that receive fasteners for securing the pipe brace section to other pipe brace sections or the foot assembly. Further, a central hole 246 is shown in each connection plate 238, 216 that may receive the threaded rod of a shoe assembly, such as when the threaded rod is retracted to provide the shoe assembly with a shorter or intermediate length. Since the holes in the connection plates 238, 216 shown in FIGS. 11 and 12 are located at the same or substantially similar positions to the connection plates shown in the embodiments above, these connection plates 238, 216 may be attached to the other illustrated connection plates 38, 16, 138, 116.

Figure 13:
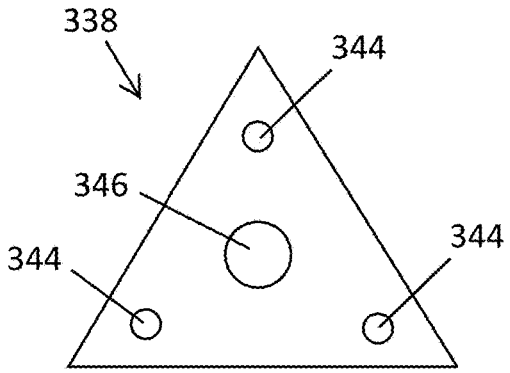
FIG. 13 is an end view of an additional connection plate of a pipe brace section.
Figure 14:
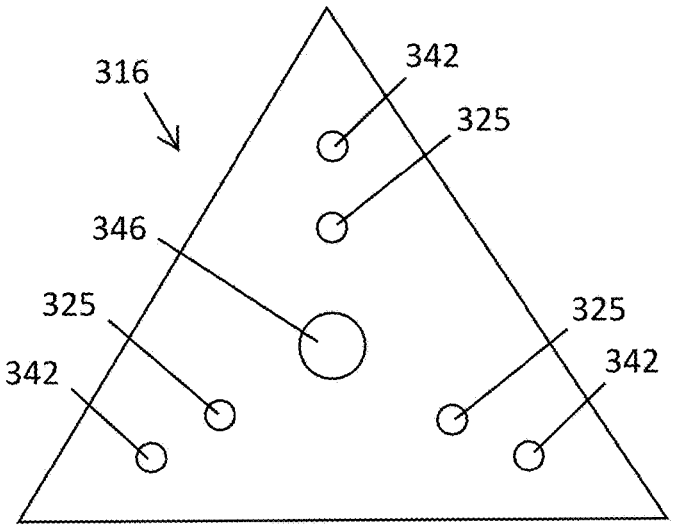
FIG. 14 is an end view of an additional connection plate of a pipe brace section.

Also, FIGS. 13 and 14 show triangular shaped connection plates that may be integrated with the modular pipe brace assembly. As shown in FIG. 13, a smaller connection plate 338 is provided for a shorter brace section and a larger connection plate 316 is provided for a longer brace section. Again, similar to the examples shown and described above, the connection plates 338, 316 have multiple holes for temporarily attaching to different brace sections or foot assemblies. However, the smaller connection plate 338 has three perimeter holes that are disposed at the outer flange of the corresponding brace section, such that fasteners that engage the holes are disposed outside the hollow interior of the pipe of the corresponding brace section. The connection plate 316 has two sets of outer peripheral holes 342, 325 that each have three holes for receiving fasteners for securing the pipe brace section to other pipe brace sections or the foot assembly. Further, a central hole 346 is shown in each connection plate 338, 316 that may receive the threaded rod of a shoe assembly, such as when the threaded rod is retracted to provide the shoe assembly with a shorter or intermediate length.

The modular pipe brace assembly disclosed herein may be used with multiple and various types of construction projects and applications by assembling the different brace sections in desired bracing lengths. The cross-sectional geometry, material type selections, and material thickness within the cross-sectional profile of the components of the pipe brace assembly may be configured for such a particular use and the desired loading and performance characteristics of the pipe brace assembly as generally understood.

For purposes of this disclosure, the terms "upper," "lower," "right," "left," "rear," "front," "vertical," "horizontal," "inner," "outer," "inner-facing," "outer-facing," and derivatives thereof shall relate to the pipe assemblies as oriented in FIG. 1. However, it is to be understood that the invention may assume various alternative orientations, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present invention, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A modular pipe brace assembly for supporting a concrete wall panel, the modular pipe brace assembly comprising:

a plurality of brace sections that each have a pipe with one of at least two standard lengths and a connection plate attached to each end of the pipe;

wherein the connection plates are attached in perpendicular planar alignment relative to the length of the respective pipe;

wherein the connection plates comprise a flange that extends radially outward from the respective pipe, a first set of holes that extend through the flange in corners of the connection plates, and a second set of holes that extend through the connection plates at a different radial distance than the first set of holes relative to a longitudinal center of the pipe brace assembly;

wherein at least two braces of the plurality of brace sections are removably attached together with central axes of the at least two braces longitudinally aligned and with the connection plates at adjacent ends of the at least two braces abutting together to define a pipe assembly with a desired length;

a first plurality of fasteners engaged through the first set of holes in the abutting connection plates to engage a corresponding plurality of nuts to secure the at least two braces together;

a pair of adjustable shoe assemblies removably attached to opposing ends of the pipe assembly and configured to engage a ground anchor or a concrete wall panel, wherein the pair of adjustable shoe assemblies each have a mounting plate that attach to the connection plates at the ends of the pipe assembly; and a second plurality of fasteners are engaged through the mounting plates and the second set of holes in the flange of the connection plates to temporarily secure the pair of adjustable shoe assemblies to the pipe assembly;

wherein the adjustable shoe assembly comprises a rod operably engaged with the mounting plate and a shoe attached to an end of the rod, and wherein upon rotation of the rod, the shoe is longitudinally displaced relative to the mounting plate.

2. The modular pipe brace assembly of claim 1, wherein the second set of holes are disposed radially inward from the first set of holes in the connection plate.

3. The modular pipe brace assembly of claim 1, wherein the pipe assembly is configured to be disassembled and reassembled with another one of the plurality of brace sections to define a second pipe assembly, and wherein the second pipe assembly comprises a second desired length taken along a longitudinal extent of the second pipe assembly that is longer than the desired length of the pipe assembly.

4. The modular pipe brace assembly of claim 1, wherein the mounting plates of the pair of shoe assembles are attached in abutting contact to the connection plates at the opposing ends of the pipe assembly.

5. The modular pipe brace assembly of claim 4, wherein the second set of holes in the flange of the connection plates include a threaded surface to engage the second plurality of fasteners.

6. A modular pipe brace assembly for supporting a concrete wall panel, said modular pipe brace assembly comprising:

a plurality of brace sections that each have a long pipe and a connection plate attached to each end of each of the plurality of brace sections, wherein the connection plates comprise a flange that extends radially outward from the respective long pipe, a first set of holes that extend through the flange and are disposed in corners of the connection plates, and a second set of holes in the connection plate disposed radially inward from the first set of hole;

wherein two of the plurality of brace sections are attached together with a central axis of each of the attached brace sections disposed in longitudinal alignment with each other to define a pipe assembly with a desired bracing length;

wherein the connection plates at attached ends of the attached brace sections abut together; and a first plurality of fasteners engaged through the first sets of holes in the connection plates at the attached ends to temporarily secure the pipe assembly together;

a pair of adjustable shoe assemblies that each have a mounting plate attached in abutting contact to the connection plates at the ends of the pipe assembly; and a second plurality of fasteners engaged through the mounting plate and the second set of holes in the connection plates to temporarily secure each of the pair of adjustable shoe assemblies to the pipe assembly;

wherein the pair of adjustable shoe assembly each comprise a rod operably engaged with the mounting plate and a shoe attached to an end of the rod, and wherein upon rotation of the rod, the shoe is longitudinally displaced relative to the mounting plate.

7. The modular pipe brace assembly of claim 6, wherein the adjustable shoe assembly attached to each end of the pipe assembly is configured to engage a ground anchor or a concrete wall panel.

8. The modular pipe brace assembly of claim 7, wherein the first and second set of holes are disposed on the connection plate a different radial distances relative to the center axis of the attached brace sections.

9. The modular pipe brace assembly of claim 6, wherein the plurality of brace sections each have a common length.

* * * * *